US005846407A

United States Patent [19]

Fuerstenau et al.

[11] Patent Number: 5,846,407

[45] Date of Patent: Dec. 8, 1998

[54] PYRITE DEPRESSANT USEFUL IN FLOTATION SEPARATION

[76] Inventors: Douglas W. Fuerstenau, 1440 LeRoy Ave., Berkeley, Calif. 94708; Guy H. Harris, 1673 Georgia Dr., Concord, Calif. 94519

[21] Appl. No.: 877,319

[22] Filed: Jun. 17, 1997

Related U.S. Application Data

[60] Provisional application No. 60/019,815, Jun. 17, 1996.

[51] Int. Cl.[6] ..... B03D 1/012; B03D 1/06

[52] U.S. Cl. ..... 209/167; 252/61

[58] Field of Search ..... 209/166, 167, 209/901; 252/61

[56] References Cited

U.S. PATENT DOCUMENTS 2,336,868 12/1943 Jayne .
3,093,666 6/1963 Du Brow .
3,220,839 11/1965 Herz .
3,414,128 12/1968 Baarson .
3,426,896 2/1969 Baarson .
5,560,814 10/1996 Burkhart .

FOREIGN PATENT DOCUMENTS 57-136957 8/1982 Japan .
59-92045 5/1984 Japan .

*Primary Examiner*—Thomas M. Lithgow
*Attorney, Agent, or Firm*—Harold D. Messner

[57] ABSTRACT

The present invention relates to a process for separating pyrite from sulfide ores and coal during flotation separation which comprises the depression of pyrite with from about 0.125 to 1.250 pounds per ton of 2-S thironium-ethane sulfonate (IESA) as a pyrite depressant. The aforementioned depressant is surprisingly effective in pyrite removal, being substantially independent of the pH values of the treated ore or coal, compatible with conventional collector reagents such as xanthates in the case of copper sulfide bearing ores as well as being substantially unobtrusive in not depressing other useful ore sulfides, including but limited to chalcopyrite, bornite, chalcosite, etc.

1 Claim, 2 Drawing Sheets

| | COAL SAMPLE |
|---|---|
| PARAMETER | Illinois No. 6 |
| Feed Sample | |
| Grinding sample | 500 g |
| Flotation test feed | 125 ± 5 g |
| Method of splitting | riffle |
| Flotation time | 5 minutes |
| Flotation Equipment and Operating Conditions | |
| Machine type | Denver Machine with 2-liter DOE cell |
| Machine rotor speed | 1200 rpm |
| Froth paddle speed | 36 rpm |
| Water | 1000 $cm^3$ |
| Level make up method | manual |
| Cell, level below lip | 20 mm |
| Aeration rate | 4 liters/minute |
| Conditioning Times | |
| Pulping time | 2 minutes |
| Pulp level adj. and pH meas. time | 1 minute |
| Collector cond. time | 1 minute |
| Frother cond. time | 3 minutes |
| Total cond. time | 7 minutes |
| Collector dosage (100 µl = 1.20 lb/T) | |
| Dodecane | 5.76 lb/T (480 |
| Frother dosage (100 µl = 1.30 lb/T) | |
| MIBC | 1.17 lb/T (90 µl) |

FIG. 1

PYRITE DEPRESSANT USEFUL IN FLOTATION SEPARATION

RELATED APPLICATION

This is a continuation of Ser. No. 60/019,815, filed Jun. 17, 1996.

SCOPE OF THE INVENTION

The present invention relates to a depressant that is surprisingly effective in depressing pyrite during flotation separation of sulfide ores and coal and more particularly to surprisingly useful depressant that diverts surprisingly large amounts of pyrite on a normalized basis during removal of useful minerals of such ores and/or removal of contaminants (that includes, of course, pyrite) from coal.

BACKGROUND OF THE INVENTION

The need to depress pyrite during flotation of sulfide ores and/or coal is well-known. With particular regard to the former, diverting the pyrite into waste material, significantly upgrades the concentrates of the resulting ores as well as reduces smelting costs since there less sulfur dioxide and sulfuric acid produced as byproducts. With particular regard to the need to depress pyrite in coal, calorific content is improved with its removal, as well as proving a concomitant reduction in sulfur emissions, enabling the user to more easily meet Federal and State regulations.

While a vast array of reagents for pyrite depression have been proposed and reported, we are unaware of use of 2-S thiouronium ethane sulfonate (IESA) as a pyrite depressant during both coal and copper sulfide flotation operations, and moreover, we are surprised by the effectiveness thereof in such operations.

SUMMARY OF THE INVENTION

The present invention relates to a process for separating pyrite from sulfide ores and coal during flotation separation which comprises the depression of pyrite with from about 0.125 to 1.250 pounds per ton of 2-S thiouronium ethane sulfonate (IESA) as a pyrite depressant. The aforementioned depressant is surprisingly effective in pyrite removal, being substantially independent of the pH values of the treated ore or coal, compatible with conventional collector reagents such as xanthates in the case of copper sulfide bearing ores as well as being substantially unobstructive in not depressing other useful ore sulfides, including but limited in chalcopyrite, bornite, chalcosite, etc.

STRUCTURAL FORMULA

The structural formula 2-S thiouronium-ethane sulfonate (IESA) is as follows:

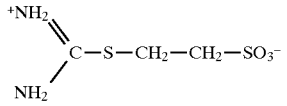

The $pK_a$ of benzenesulfonic acid is: $pK_{a1}$ = 2.554 [1], and that of mercaptoethane sulfonic acid is: $pK_{a2}$ = 9.5 [1].

PREPARATION

The main reaction in the synthesizing of 2-S thiouronium ethane sulfonate (IESA) is as follows:

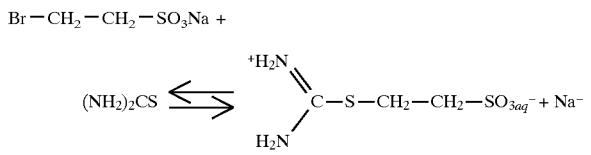

Sodium 2-bromoethane sulfonate is allowed to react under carefully controlled conditions with thiourea to yield 2-S thiouronium-ethan sulfonate. This compound is then recrystallized from an aqueous solution as a hard-white-crystalline solid.

For this purpose, 0.4 mole of sodium 2-bormoethane sulfonate (98%, pure) is reacted with 0.31 mole of thiourea (99%pure) in 110 cubic centimeters of triple-distilled water. The solution is stirred and heated to 95 degrees centigrade until total dissolution or thiourea occurs, the latter being added when the solution is at about 60 degrees centigrade. The temperature is maintained at 95 degrees centigrade for 1 hour before the addition of one gram of potassium iodine (KI) to accelerate the precipitation of the 2-S, thiouronium-ethan sulfonate. The agitator is stopped and the system cooled to 60 degrees centigrade for 1 hour. The solution is maintained at such temperature for about 12 hours. The temperature is then further reduced to 22 degrees centigrade for 24 hours to crystallize the 2-S thiouronium-ethane sulfonate.

After first precipitation, the system is reheated to 95 degrees centigrade to slowly redissolve the precipitated 2-S thiouronium-ethane sulfonate. The solution is then cooled to room temperature for 4 hours to recrystallize the 2-S thiouronium-ethane sulfonate. Final pH: about 1.78.

Filtration of the 2-S thiouronium-ethane sulfonate is then carried out by washing the precipitate with 490 cubic centimeters of triple-distilled water. The crystals are then dried under vacuum for 24 hours. 600 cubic centimeters of the solution is then reduced to about 120 cubic centimeters by evaporation at 60 degrees centigrade for 48 hours. Then the temperature is reduced to 35 degrees centigrade and the solution evaporated for another 48 hours, to obtain about 50 cubic centimeters. Under such conditions, additional 2-S thiouronium-ethane is crystallized, filtered and dried under vacuum for 24 hours.

Crystals of 2-S thiouronium-ethane sulfonate obtained by filtration those obtained after evaporation of the filtrate are combined, dissolved and crystallized following the above procedure. The system is then filtrated and the crystals dried under vacuum for 24 hours. A conversion yield of 50 per cent is obtained, the 2-S thiouronium-ethane sulfonate crystals being about 98 per cent pure.

BRIEF DESCRIPTION OF THE DRAWINGS

FIG. 1 shows the standard flotation test conditions.

COAL FLOTATION EXPERIMENTS

Figure 2:
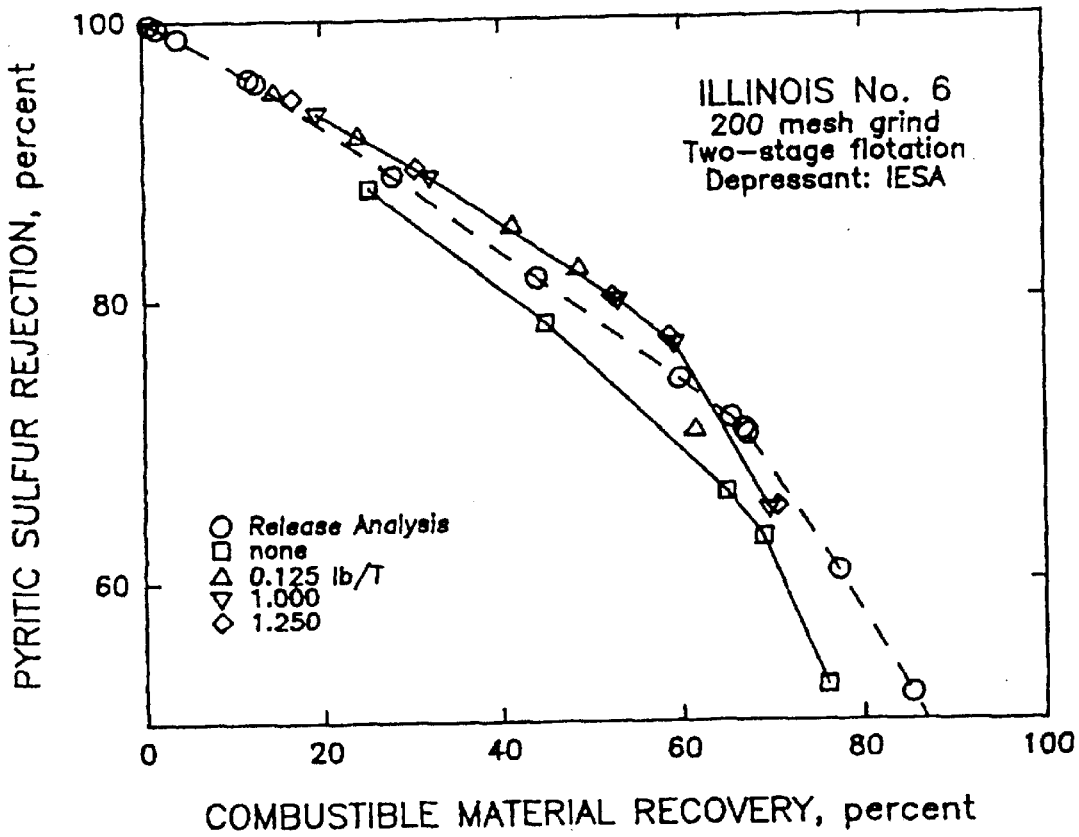
FIG. 2 shows the presence of 2-S thiouronium-ethane sulfonate improved the pyritic sulfer rejection significantly.

Two step batch flotation test for a high-sulfur bituminous coals was conducted (ILLINOIS NO. 6) in a conventional floatation machine with a two-paddle flotation cell. The first step was performed while maintaining the pulp level to a predetermined mark on the cell, using manual controls. Mechanical scrappers were adjusted to a speed between 0 and 40 rpm. Air flow was controlled by a diaphragm pump connected to a three-way valve and flowmeter assembly.

Table 1 shows the standard floatation test conditions in more detail. Note that purified dietician was selected as the collector rather than kerosene to gain source independence. The frother was conventional (MIBC). The tailings were filtered, dried, weighed and analyzed.

The concentrate from first step was then re-floated. The pulp was conditioned for about 1 minute, with additional frother being added and conditioned for about 3 minutes (0.58 kg per ton was added as frothed for ILLINOIS NO. 6). No collector added. After release of air, the froth was collected at different time intervals, viz. at 0.5, 1, 3 and 5 minutes after initialization had been completed.

Filtering, drying, weighing and analyze of the concentrates and tailings been occurred as shown in Table 2 for the above coal sample in per cent of pyritic sulfur rejection as a function of per cent of combustible material recovery (CMR).

Table 2 shows that the presence of 2-S thiouronium-ethane sulfonate (IESA) improved the pyritic sulfur rejection significantly (with respect to the results obtained in the absence of IESA for this sample). Furthermore a separation efficiency is depicted that is better than that obtained a procedure called "release analysis") normalized to common collector and frothed dosages, at least for CMR's of 64% and below. Note also at 60% CMR an addition of 0.062 kilograms per ton of IESA improves the pyritic sulfur rejection by 2.4% over that obtained by release analysis which the best separation efficiency that can be obtained in the absence of IESA. Furthermore, IESA increases the pyritic sulfur rejection by 7.5% at the same CAR. Moreover, this high pyritic sulfur rejection is maintained even when 0.625 kilogram per ton of IESA is added. According to Hallimon tube flotation, electrokinetic and rheology studies, IESA appears not to be adsorbed onto the surface of the pyrite. Nevertheless, IESA is adsorbed on the surface of the coal sample, rendering its zeta potential positive. Hence, the system coal-pyrite is dispersed, increasing the pyritic sulfur rejection.

(Release or tree analysis is a standard procedure to determine best possible separation with standard test conditions. In this procedure the initial feed is floated for 5 minutes in a standard floatation cell but with ¼ of the collector and frothed dosages. This assures that most hydrophobic materials is floated first. The tailings are then subjected to a sequence of three more scavenging floatation steps. Each step requires an additional ¼ of both the collector and frothed until the final tailings product is obtained. The concentrates generated by the successive floatation of the first, second and third tailings are estimated to have a mass of more than 1% of the initial feed. These concentrates are then submitted to further cleaning. The initial floatation concentrate is also repeatedly floated until all entrapped mineral matter is removed. The tailings fractions associated with initial concentrate are also subjected to further cleaning steps. Both concentrates and tailing are kept separate for individual cleaning and scavenging. Mechanical floatation variables including floatation time are kept constant. Tree analysis is aimed at identifying best possible separation by floatation. A curve thus generated has a locus that represents (a) products of maximum coal matrix content (but minimum ash and pyritic sulfur content), (b) products of the minimum coal matrix content (but maximum ash and pyritic sulfur content) and all other intermediate products in between (a) and (b), supra. Of course collector and frothed concentration for each coal sample correspond to that level used in the standard floatation test.)

Whereas there are here specifically set forth certain preferred procedures which are presently regarded as the best mode for carrying out the invention, it should be understood by one skilled in the art, that various changes, modifications and improvements can be made and other procedures adapted without departing from the scope of the invention particularly pointed out and claimed hereinbelow. For example, S-carboxlmethylene isothiourea (S-CMIU) could be substitute for 2-S thiouronium-ethane sulfonate (IESA) as a pyrite depressant, as described above. In addition, the known material GHB-2 has also be shown to be a pyrite depressant.

We claim:

1. A process for separating pyrite from sulfide ores and coal which comprises subjecting said sulfide ore or coal containing said pyrite to flotation in the presence of a depressant for pyrite, said depressant comprises about 0.125 to 1.250 pounds per ton of 2-S thiouronium-ethane sulfonate.

* * * * *

UNITED STATES PATENT AND TRADEMARK OFFICE
Certificate

Patent No. 5,846,407 Patented: December 8, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Douglas W. Fuerstenau, Berkeley, CA; Guy H. Harris, Concord, CA; and Francisco J. Sotillo, Lakeland, FL.

Signed and Sealed this Thirtieth Day of July 2002.

DAVID A. SIMMONS
*Supervisory Patent Examiner*
Art Unit 1724